US010974309B2

(12) United States Patent
Gotterbarm et al.

(10) Patent No.: US 10,974,309 B2
(45) Date of Patent: Apr. 13, 2021

(54) CONDENSER TUBES WITH ADDITIONAL FLANK STRUCTURE

(71) Applicant: WIELAND-WERKE AG, Ulm (DE)

(72) Inventors: Achim Gotterbarm, Dornstadt (DE); Jean El Hajal, Ulm (DE); Andreas Beutler, Weissenhorn (DE)

(73) Assignee: WIELAND-WERKE AG, Ulm (DE)

( * ) Notice: Subject to any disclaimer, the term of this patent is extended or adjusted under 35 U.S.C. 154(b) by 119 days.

(21) Appl. No.: 16/151,828

(22) Filed: Oct. 4, 2018

(65) Prior Publication Data

US 2019/0033010 A1 Jan. 31, 2019

Related U.S. Application Data

(62) Division of application No. 14/357,969, filed as application No. PCT/EP2012/004706 on Nov. 13, 2012, now Pat. No. 10,094,625.

(30) Foreign Application Priority Data

Dec. 16, 2011 (DE) ..... 10 2011 121 436.8

(51) Int. Cl.
*F28F 1/26* (2006.01)
*B21J 5/06* (2006.01)
(Continued)

(52) U.S. Cl.
CPC ..... *B21J 5/068* (2020.08); *F28F 1/12* (2013.01); *F28F 1/24* (2013.01); *F28F 1/26* (2013.01);
(Continued)

(58) Field of Classification Search
CPC .. F28F 1/36; F28F 2215/10; F28F 1/12; F28F 1/24; F28F 1/26; F28F 1/34; F28F 1/422
See application file for complete search history.

(56) References Cited

U.S. PATENT DOCUMENTS 2,709,074 A 5/1955 Gannon
3,326,283 A 6/1967 Ware
(Continued)

FOREIGN PATENT DOCUMENTS

CN 1366170 A * 8/2002 ..... F28F 1/42
CN 101004335 A 7/2007
(Continued)

OTHER PUBLICATIONS

German Patent Office Action for corresponding application No. 10 2011 121 436.8, dated Oct. 8, 2012 (7 pages).
(Continued)

*Primary Examiner* — Leonard R Leo
(74) *Attorney, Agent, or Firm* — Flynn Thiel, P.C.

(57) ABSTRACT

A heat exchanger tube with a tube axis, a tube wall and with ribs extending around on the tube outer side. The ribs have a rib foot, rib flanks and a rib tip, wherein the rib foot projects substantially radially from the tube wall. The rib flanks are provided with additional structural elements which are arranged laterally on the rib flank. First material projections, which extend substantially in the axial and radial direction, adjoin second material projections which extend substantially in the axial and circumferential direction of the tube, wherein the first and second material projections have a common boundary line. The axial extent of the first material projections along this boundary line is less than the axial extent of the second material projections.

2 Claims, 7 Drawing Sheets

(51) Int. Cl.

| | |
|---|---|
| ***F28F 1/24*** | (2006.01) |
| ***F28F 1/36*** | (2006.01) |
| ***F28F 1/12*** | (2006.01) |
| ***F28F 21/08*** | (2006.01) |
| *F28F 1/34* | (2006.01) |
| *F28F 1/42* | (2006.01) |
| *F28D 21/00* | (2006.01) |

(52) U.S. Cl.

CPC ..... *F28F 1/36* (2013.01); *F28F 21/08* (2013.01); *F28D 2021/0063* (2013.01); *F28F 1/34* (2013.01); *F28F 1/422* (2013.01); *F28F 2215/10* (2013.01)

(56) References Cited

U.S. PATENT DOCUMENTS

| | | | | |
|---|---|---|---|---|
| 4,179,911 | A | 12/1979 | Saier et al. | |
| 4,660,630 | A | 4/1987 | Cunningham et al. | |
| 5,203,404 | A | 4/1993 | Chiang et al. | |
| 5,333,682 | A | 8/1994 | Liu et al. | |
| 5,513,699 | A * | 5/1996 | Menze | F28F 13/187 165/184 |
| 5,775,411 | A | 7/1998 | Schuez et al. | |
| 5,992,513 | A | 11/1999 | Suzuki et al. | |
| 7,178,361 | B2 * | 2/2007 | Thors | F28F 1/42 165/184 |
| 9,618,279 | B2 * | 4/2017 | Lutz | F28F 1/12 |
| 2003/0015316 | A1 | 1/2003 | Burkay | |
| 2007/0034361 | A1 | 2/2007 | Lu et al. | |
| 2007/0131396 | A1 | 6/2007 | Yu et al. | |
| 2008/0196876 | A1 | 8/2008 | Cao et al. | |
| 2009/0008069 | A1 | 1/2009 | Luo et al. | |
| 2009/0260792 | A1 | 10/2009 | Yalin et al. | |
| 2010/0288480 | A1 | 11/2010 | Beutler et al. | |

FOREIGN PATENT DOCUMENTS

| | | | |
|---|---|---|---|
| CN | 101004337 | A | 7/2007 |
| CN | 101556124 | A | 10/2009 |
| DE | 44 04 357 | C2 | 5/1998 |
| JP | 2011-518303 | A | 6/2011 |

OTHER PUBLICATIONS

German Patent Office Action for corresponding application No. 10 2011 121 436.8, dated Aug. 2, 2016 (5 pages).

Japan Patent Office Action for corresponding application No. 2014-546339, dated Aug. 4, 2015 (10 pages).

International Search Report issued in PCT/EP2012/004706, with English translation, dated Apr. 5, 2013 (8 pages).

* cited by examiner

CONDENSER TUBES WITH ADDITIONAL FLANK STRUCTURE

CROSS-REFERENCE TO RELATED APPLICATIONS

This is a divisional of prior U.S. application Ser. No. 14/357,969, now U.S. Pat. No. 10,094,625, which was the national stage of International Application No. PCT/EP2012/004706, filed Nov. 13, 2012.

FIELD OF THE INVENTION

The invention relates to a metal heat exchanger tube, especially for the liquefaction or condensation of vapors on the tube outer side.

BACKGROUND OF THE INVENTION

Heat transfer occurs in many technical processes, for example in refrigeration and air conditioning technology or in chemical and energy technology. In heat exchangers, heat is transferred from one medium to another medium. The media are usually separated by a wall. This wall serves as a heat transfer surface and for separating the media.

In order to enable the transporting of heat between the two media, the temperature of the heat-releasing medium heat has to be higher than the temperature of the heat-absorbing medium. This temperature difference is referred to as the driving temperature difference. The higher the driving temperature difference is, the more heat that can be transferred per unit of the heat transfer surface. On the other hand, attempts are frequently made to minimize the driving temperature difference since this has advantages for the efficiency of the process.

It is known that heat transfer can be improved by the structuring of the heat transfer surface. In this way, the effect can be achieved of more heat being able to be transferred per unit of the heat transfer surface than in the case of a smooth surface. Furthermore, it is possible to reduce the driving temperature difference and therefore to make the process more efficient.

Shell and tube heat exchangers are a frequently used design of heat exchangers. In these devices, use is frequently made of tubes which are structured both on their inner and outer sides. Structured heat exchanger tubes for shell and tube heat exchangers usually have at least one structured section and also have smooth end pieces and possibly smooth intermediate pieces. The smooth end pieces or intermediate pieces delimit the structured sections. So that the tube can be installed in the shell and tube heat exchanger without any problem, the outside diameter of the structured sections must not be larger than the outside diameter of the smooth end pieces and intermediate pieces.

Various measures are known for increasing heat transfer during the condensation process on the tube outer side. Fins are frequently applied to the outer surface of the tube. As a result, the surface of the tube is primarily increased and consequently the condensation process is intensified. For heat transfer, it is especially advantageous if the fins are formed from the wall material of the smooth tube since an optimum contact between fin and tube wall then exists. Finned tubes, in which the fins have been formed by means of a forming process from the wall material of a smooth tube, are referred to as integrally rolled finned tubes.

Today, commercially available finned tubes for condensers have a fin structure on the tube outer side with a fin density of 30 to 45 fins per inch. This corresponds to a fin pitch of approximately 0.85 to 0.55 mm. A further performance enhancement by increasing the fin density is limited by the inundation effect which occurs in shell and tube heat exchangers. With the spacing of the fins becoming smaller, the interspace of the fins is flooded with condensate as a result of the capillary effect and draining off of the condensate is hindered as a result of the channels between the fins being made smaller.

The prior art further increases the surface of the tube by introducing notches in the fin tips. Additional structures, which positively influence the condensation process, are also created as a result of the notches. Examples of notches in the fin tips are known from printed documents U.S. Pat. Nos. 3,326,283 and 4,660,630.

Furthermore, it is known that performance enhancements can be achieved in condenser tubes by additional structural elements being introduced between the fins in the region of the fin flanks with a constant fin density. Such structures can be formed on the fin flanks by means of toothed wheel-like tools. The material projections which are created in this case project into the interspace of adjacent fins. Embodiments of such structures are found in printed documents DE 4404357 C2, CN 101004335 A, US 2007/0131396 A1 and US 2008/0196876 A1. The material projections which are described in these printed documents extend in the axial and circumference directions of the tube. In US 2010/0288480 A1, it is proposed to form the material projections so that they are delimited by one or more convexly curved surfaces. In printed documents CN 101004337 A and US 2009/0260792 A1, additional material projections, which extend in the main in the axial and radial directions, are shown on the fin flank. These material projections are arranged in the circumferential direction on the edges of the material projections and formed approximately perpendicularly to these. Consequently, each radially extending material projection has a common boundary line with a circumferentially extending material projection. Along this boundary line, the axial extent of both material projections is equal. As a result, pocket-like structures, which are delimited in each case by three material projections and the fin flank, are created on the rib flank. The condensate accumulates preferably in these pocket-like structures on account of capillary forces. As a result, further condensation of vapor is hindered and the performance of the tube is reduced.

OBJECT OF THE INVENTION

The invention is based on the object of producing a performance-enhanced heat exchanger tube, compared with the prior art, for the condensation of vapors on the tube outer side with the same tube-side heat transfer and pressure drop and also with the same production costs.

The claims refer to advantageous designs and developments of the invention.

SUMMARY OF THE INVENTION

The invention includes a heat exchanger tube with a tube axis, a tube wall and with encompassing fins on the tube outer side. The fins have a fin root, fin flanks and a fin tip, wherein the fin root mainly projects radially from the tube wall. The fin flanks are provided with additional structural elements which are arranged laterally on the fin flank. First material projections, which extend mainly in the axial and radial directions, adjoin second material projections which mainly extend in the axial and circumferential directions of the tube, wherein the first and second material projections have a common boundary line. According to the invention, the axial extent of the first material projections along this boundary line is smaller than the axial extent of the second material projections.

The present invention consequently relates to structured tubes for use in heat exchangers in which the heat-releasing medium is liquefied or condensed. Shell and tube heat exchangers, in which vapors of pure substances or mixtures condense on the tube outer side and in the process heat a liquid flowing on the tube inner side, are frequently used as condensers.

The invention is based in this case on the consideration that performance enhancements can be achieved in condenser tubes by additional structural elements in the form of material projections being formed laterally on the fin flanks. These material projections are formed from material of the upper fin flank by material of the fin being raised and displaced, similar to a blade, by means of a toothed wheel-like tool, but not separated from the fin flank. The material projections remain firmly connected to the fin. The material projections extend in the axial direction from the fin flank into the interspace between two fins. As a result of the material projections, the surface of the tube is enlarged. Furthermore, the edges of the material projections which face away from the fin flank represent convex edges on which the condensation process preferably takes place.

The teeth of the toothed wheel-like tool have a preferably symmetrical trapezoidal shape in their working section. The internal angles on the cutting edge of the teeth are slightly larger than 90°, preferably being between 95° and 110°. On account of the trapezoidal shape of the teeth, material displacement by the toothed wheel-like tool is carried out both in the radial and circumferential directions of the tube. Therefore, in one working step, first lateral material projections, which mainly extend in the axial and radial directions, and second lateral material projections, which mainly extend in the axial and circumferential directions of the tube, are formed. It basically means in this case that small deflections from the axial or radial or circumferential directions are also included. In particular, the first lateral material projections can extend in a manner deviating from the radial direction by up to 20° on account of the geometry of the toothed wheel-like tool. Also, the second material projections can especially have a curved shape. The second material projections are preferably arranged approximately half way up the fin height. The height of the fins is measured from the tube wall to the fin tip and is preferably between 0.5 mm and 1.5 mm.

First material projections adjoin second material projections, wherein an angle of slightly greater than 90° is included on the boundary line. Pocket-like structures, which are delimited by the first and second lateral material projections, are created on the fin flanks, corresponding to the radial extent of the first and second material projections. Since the condensate preferably accumulates in these pocket-like structures on account of capillary forces, the first and second lateral material projections need to be designed so that the capillary forces are reduced. Large capillary forces, which retain the condensate, occur on concavely shaped structures. Concave edges are formed where the first lateral material projections adjoin the second lateral material projections.

According to the invention, the material displacement by means of the toothed wheel-like tool is more strongly pronounced in the radial direction than in the circumferential direction of the tube. The particular advantage is that the axial extent of the first material projections along the boundary line is then smaller than the axial extent of the second material projections. Therefore, only small pocket-like structures are formed. Consequently, only a very small amount of condensate can be retained in the pocket-like structures between the material projections. In particular, the pocket-like structures which are formed are less strongly pronounced than the structures which are represented in printed documents CN 101004337 A and US 2009/0260792 A1. Therefore, in the case of first and second material projections which are designed according to the invention, there is more free surface available for the condensation process and the condensate can drain off more quickly from the channels between the fins. In the case of a heat exchanger tube which is designed according to the invention, heat transfer during the condensation process is therefore increased and the efficiency of the tube is improved.

It is also advantageous if the first material projections begin at the fin tip and extend right up to the second material projections. On account of the production process, the first material projections cannot extend any further in the radial direction than as far as the second material projections. Therefore, the radial extent of the first material projections is maximum if these begin at the fin tip. The surface of the tube and the length of the convex edges are then greatly increased but only small pocket-like structures are formed.

A particularly advantageous embodiment is made available if the maximum axial extent of the first material projections is in the region of the fin tip. Consequently, on the one hand the surface of the tube is significantly enlarged as a result of the first material projections, on the other hand only small pocket-like structures, which can retain only little condensate, are formed.

It is particularly advantageous if the axial extent of the first material projections from the fin tip towards the second material projections is made smaller. The material projections therefore taper in the direction towards the tube axis. Consequently, on the one hand, the surface of the tube is significantly enlarged as a result of the first material projections. On the other hand, the capillary forces are favorably influenced so that only little condensate can be retained in the pocket-like structures.

In contrast, it is also possible that the axial extent of the first material projections has a further local maximum between the fin tip and the second material projections. In the case of such a design of the first material projections, a large surface and a long length of the convex edge are achieved, the pocket-like structures in the region of the second material projections extending only over a small area, however.

Preferably, the axial extent of the first material projections along the boundary line is at most half as large as the axial extent of the second material projections. Consequently, the effect is achieved of the pocket-like structures on the fin flank having only a small degree of prominence.

A further aspect of the invention includes a heat exchanger tube in which the first material projections taper in the direction of the tube axis in such a way that they adjoin the second material projections only at one point. The axial extent of the first material projections is equal to zero at this limit point. Consequently, the size of the pocket-like structures is further reduced. These can then accumulate even less condensate.

Moreover, the first material projections can advantageously extend from the fin tip towards the second material projections. The achievable surface enlargement is especially maximized when the first material projections begin at the fin tip.

A further aspect of the invention includes a heat exchanger tube in which the first material projections are arranged at a distance from the second material projections. This can be realized by the radial extent of the first material projections from the fin tip not reaching as far as the second material projections. The first material projections then do not make contact with the second material projections at any point. The capillary forces, which hold the condensate in the pocket-like structures, are minimal in this case.

In a preferred embodiment of the invention, the first material projections can extend from the fin tip in the radial direction and the radial extent of the first material projections can be smaller than the radial distance of the second material projections from the fin tip. Again, the achievable surface enlargement is then especially maximized when the first material projections begin at the fin tip.

Exemplary embodiments of the invention are explained in more detail with reference to the schematic drawings.

DETAILED DESCRIPTION OF THE INVENTION

Parts which correspond to each other are provided with the same designations in all the figures.

Figure 1:
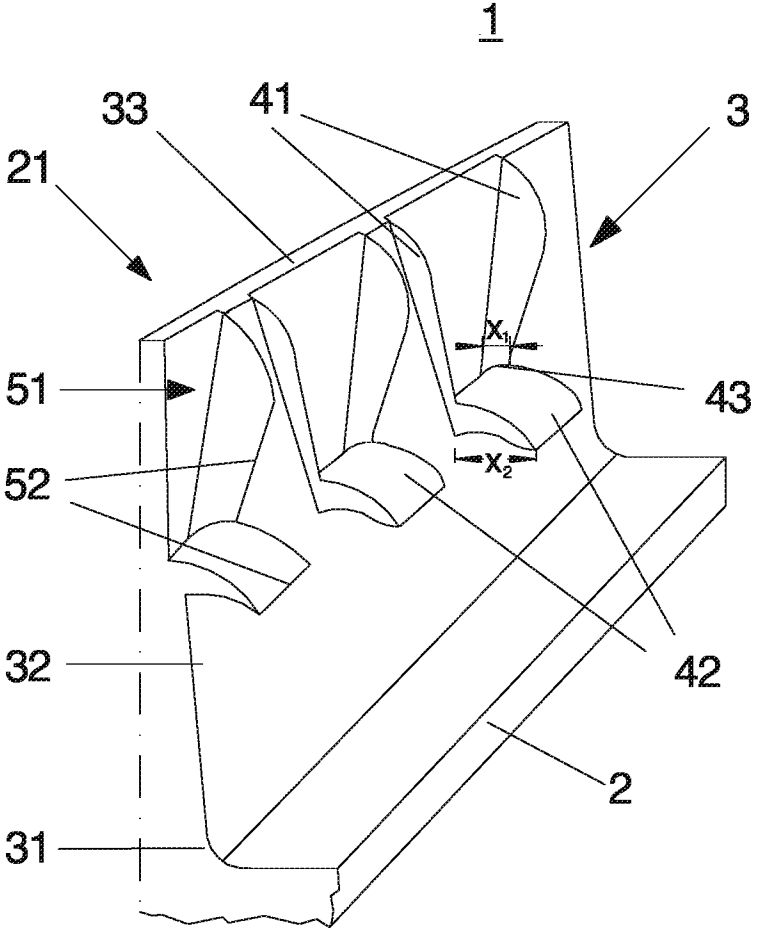
FIG. 1 shows a perspective partial view of a fin section of a heat exchanger tube with material projections according to the invention.

FIG. 1 shows a perspective partial view of a fin section of a heat exchanger tube 1 with material projections 41 and 42 according to the invention. From the tube outer side 21, only a part of one of the encompassing, integrally formed fins 3 is depicted. The fins 3 have a fin root 31, which is attached to the tube wall 2, fin flanks 32 and a fin tip 33. The fins 3 project radially from the tube wall 2. The fin flanks 32 are provided with additional structural elements which are designed as material projections 41 and 42. The material projections which are formed can be divided into two groups. First material projections 41 mainly extend in the axial and radial directions of the tube 1. Second material projections 42 mainly extend in the axial and circumferential directions of the tube. In FIG. 1, five first material projections 41 and three second material projections 42 are represented. First material projections 41 adjoin second material projections 42, wherein an angle greater than 90° is included on the boundary line 43. As a result of the material projections 41 and 42, the surface of the tube 1 is enlarged. Furthermore, the edges of the material projections 41 and 42 which face away from the fin flank represent convex edges 52 on which the condensation process preferably takes place.

As is represented in FIG. 1 to FIG. 5, the axial extent $x_1$ of the first material projections 41 along the boundary line 43 is smaller according to the invention than the axial extent $x_2$ of the second material projects 42. As a result, only slightly pronounced, pocket-like structures 51 are created on the fin flank 32. Consequently, in the case of a heat exchanger tube 1 according to the invention, hardly any condensate can accumulate in the pocket-like structures 51, but the condensate drains off quickly. Little of the surface of the tube 1 is covered with a condensate film, which represents a considerable heat resistance. This is beneficial to the condensation process and the efficiency of the tube is increased.

Figure 2:
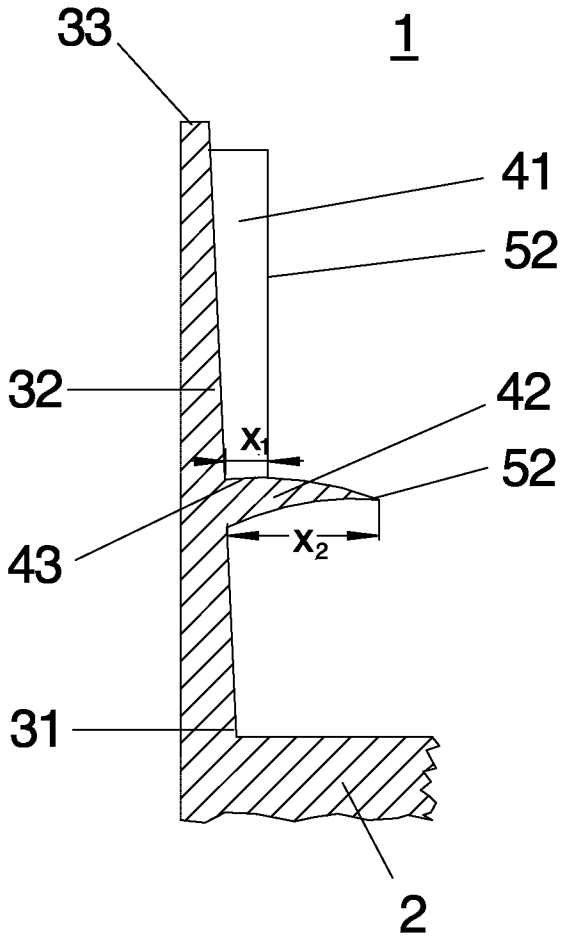
FIG. 2 shows a section through the fin of a heat exchanger tube with an embodiment of the material projections according to the invention.

FIG. 2 shows in cross-section an advantageous embodiment of the heat exchanger tube 1 according to the invention, in which the first material projections 41 begin close to the fin tip 33 and extend in the radial direction of the tube 1 right up to second material projections 42. On account of the production process, the first material projections 41 cannot extend any further in the radial direction than as far as the second material projections 42. Therefore, the radial extent of the first material projections 41 is maximum if these begin at the fin tip 33. The surface of the tube 1 and the length of the convex edges 52 are then greatly increased. As represented in FIG. 2, the second material projections 42 are attached preferably approximately half way up the height of the fins 3. The radial extent of the first material projections 41 is therefore approximately equal to half the fin height in the case represented in FIG. 2.

Figure 3:
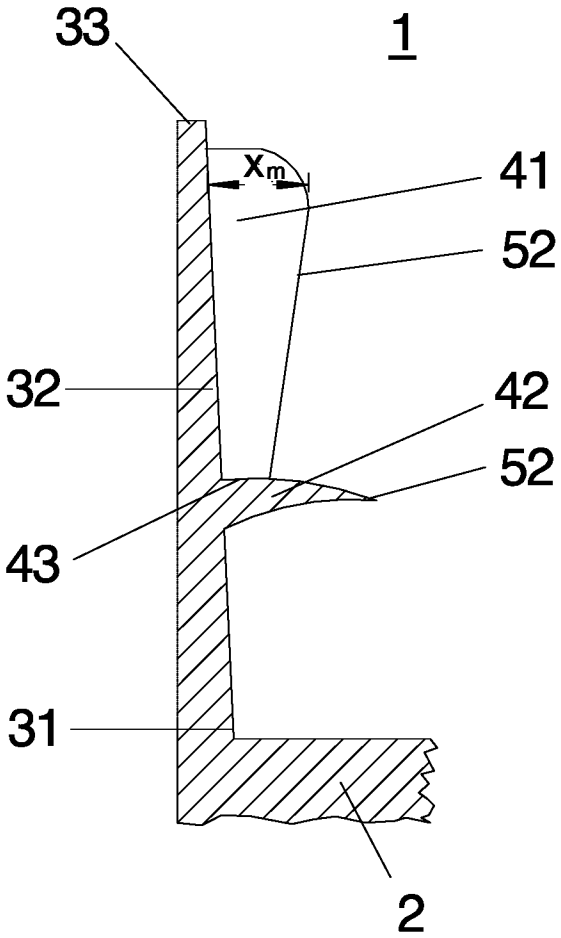
FIG. 3 shows a section through the fin of a heat exchanger tube with a preferred embodiment of the material projections according to the invention.

FIG. 3 shows in cross-section a particularly advantageous embodiment of the heat exchanger tube 1 according to the invention. The maximum axial extent $x_m$ of the first material projections 41 is in the region of the fin tip 33. Furthermore, the axial extent $x_1$ of the first material projections 41 from the fin tip 33 towards the second material projections 42 is made smaller. The first material projections 41 therefore taper in the direction of the tube axis. Therefore, on the one hand, the surface of the tube 1 is enlarged even further by means of the first material projections 41 than in the case represented in FIG. 2. On the other hand, only small pocket-like structures 51, which can retain only little condensate, are formed.

Figure 4:
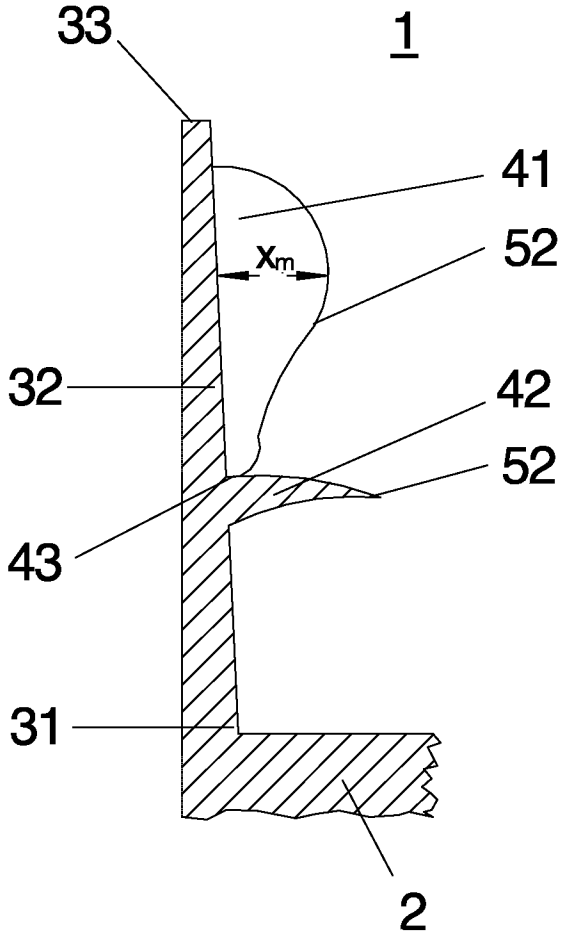
FIG. 4 shows a section through the fin of a heat exchanger tube with an especially preferred embodiment of the material projections.

In the case of the embodiment of the heat exchanger tube 1 according to the invention represented in FIG. 4, the first material projections 41 have the shape of an ear. In their principle of operation, they are comparable with the first material projections 41 of the embodiment represented in FIG. 3. The maximum axial extent $x_m$ of the first material projections 41 is slightly further away from the fin tip 33 than in the case of the embodiment represented in FIG. 3.

Figure 5:
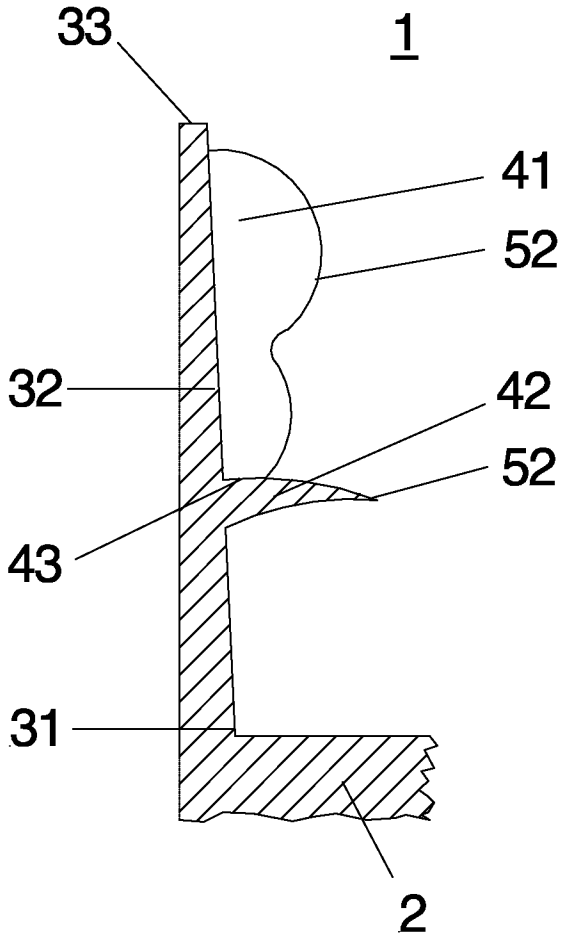
FIG. 5 shows a section through the fin of a heat exchanger tube with a further preferred embodiment of the material projections.

FIG. 5 shows in cross-section a further advantageous embodiment of the heat exchanger tube 1 according to the invention. The axial extent $x_1$ of the first material projections 41 has a further local maximum between the fin tip 33 and the second material projections 42. The contour characteristic of the first material projections 41 is, however, selected so that the first material projections 41 taper tendentially from the fin tip 33 towards the second material projections 42. In the case of this advantageous embodiment, a large surface and especially a long length of the convex edge 52 are achieved. The pocket-like structures 51 in the region of the second material projections 42 extend only over a small area.

As represented in FIG. 1 to FIG. 5, the axial extent $x_1$ of the first material projections 41 along the boundary line 43 is at most half as large as the axial extent $x_2$ of the second material projections 42. As a result, the effect is achieved of the pocket-like structures 51 having only a small prominence on the fin flank 32.

Figure 6:
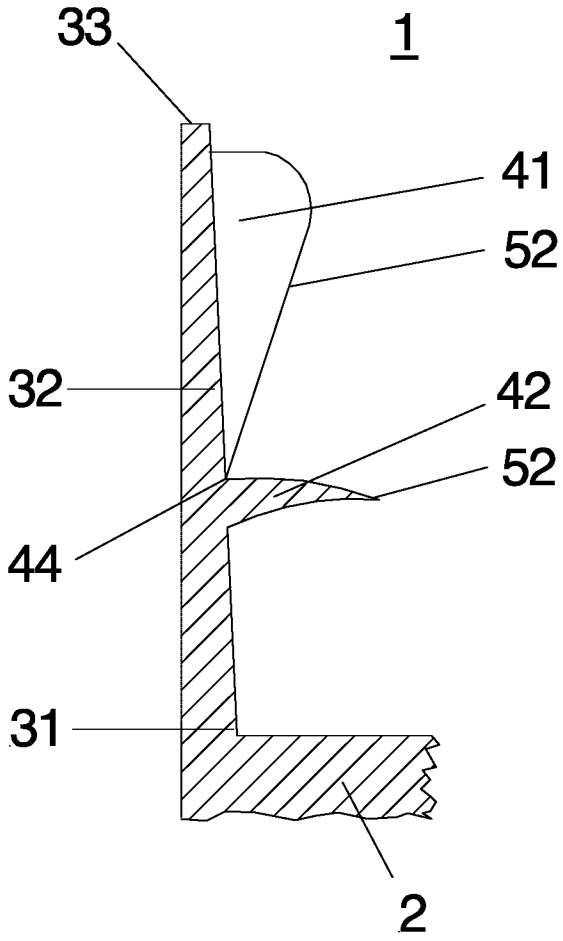
FIG. 6 shows a section through the fin of a heat exchanger tube with first and second material projections in contact only at one point.

A further aspect of the invention includes a heat exchanger tube 1 in which the first material projections 41 taper in the direction of the tube axis in such a way that they adjoin the second material projections 42 only at one point 44, as is represented in FIG. 6. This aspect of the invention represents the limit case in a way that the boundary line 43 depicted in FIGS. 1-5 between first 41 and second material projections is reduced to one point 44. The axial extent $x_1$ of the first material projections 41 is equal to zero at this limit point 44. As a result, the size of the pocket-like structures 51 is further reduced. These can then accumulate even less condensate. On the other hand, the achievable surface enlargement in this case is smaller than in the cases represented in FIGS. 1-5. Therefore, it is advantageous that the first material projections 41 begin at the fin tip 33 in the case represented in FIG. 6.

Figure 7:
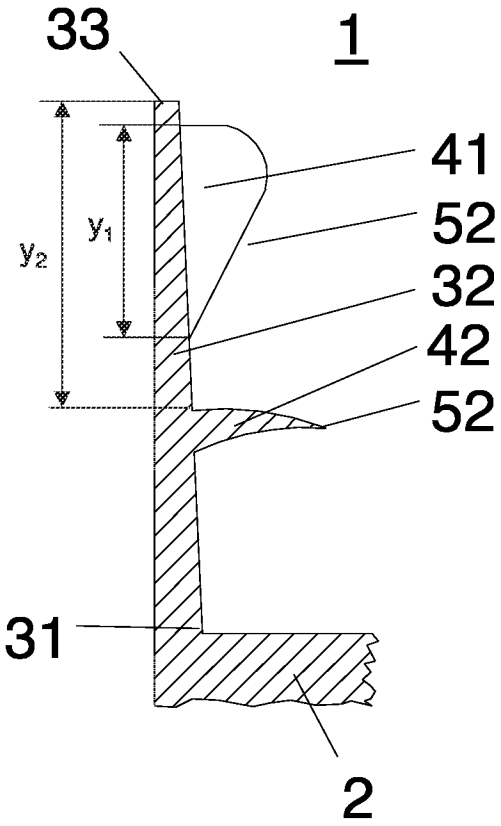
FIG. 7 shows a section through the fin of a heat exchanger tube with first and second material projections at a distance from each other.

A further aspect of the invention includes a heat exchanger tube 1 in which the first material projections 41 are arranged at a distance from the second material projections 42. An advantageous embodiment of such a heat exchanger tube 1 according to the invention is represented in cross section in FIG. 7. The radial extent of the first material projections 41 does not reach from the fin tip 33 as far as the second material projections 42. The first material projections 41 do not make contact with the second material projections 42 at any point. The first material projections 41 extend from the fin tip 33 in the radial direction and the radial extent $y_1$ of the first material projections 41 is smaller than the radial distance $y_2$ of the second material projections 42 from the fin tip 33. The capillary forces, which hold the condensate in the pocket-like structures 51, are minimal in this case. On the other hand, only a smaller surface enlargement can be achieved in this case than in the cases represented in FIGS. 1-6. Therefore, it is particularly advantageous that the first material projections 41 begin at the fin tip 33 in the case represented in FIG. 7.

The immersion process of the toothed wheel-like tool which is used for forming the material projections 41 and 42 according to the invention brings about a circumferentially asymmetrical displacement of the material of the fin flank 32. Therefore, two circumferentially adjacent, first material projections 41 can have different shapes.

Furthermore, the solution according to the invention also embraces the fact that the structuring of the fin flanks described above is advantageous not only for the condensation of vapors, but can also have a performance-enhancing effect in other heat transfer processes. In particular, during the evaporation of liquids the evaporation process can be intensified as a result of the structures according to the invention.

LIST OF DESIGNATIONS

1 Heat exchanger tube
2 Tube wall
21 Tube outer side
3 Fin on the tube outer side
31 Fin root
32 Fin flank
33 Fin tip
41 First material projection
42 Second material projection
43 Boundary line
44 Boundary point
51 Pocket-like structure
52 Convex edge
$x_1$ Axial extent of the first material projections
$x_2$ Axial extent of the second material projections
$x_m$ Maximum axial extent of the first material projections

What is claimed is:

1. A metal heat exchanger tube comprising a tube wall and fins on the tube outer side which have a fin root, fin flanks and a fin tip, wherein the fin root projects essentially radially from the tube wall, and the fin flanks are provided with additional structural elements which are arranged laterally on the fin flanks, wherein first material projections, which extend both in an axial direction and a radial direction wider than in a circumferential direction, and second material projections, which extend both in the axial direction and the circumferential direction wider than in the radial direction of the tube, are formed, and wherein the first material projections are arranged at a distance from the second material projections.

2. The metal heat exchanger tube as claimed in claim 1, wherein the first material projections extend from the fin tip in the radial direction and a radial extent of the first material projections is smaller than a radial distance of the second material projections from the fin tip.

* * * * *